US008133114B2

(12) United States Patent
Gagner

(10) Patent No.: US 8,133,114 B2
(45) Date of Patent: Mar. 13, 2012

(54) SYSTEM AND METHODS FOR CONTROLLING AN OVERHEAD SIGN FOR A GAMING SYSTEM

(75) Inventor: Mark B. Gagner, West Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 463 days.

(21) Appl. No.: 11/158,304

(22) Filed: Jun. 21, 2005

(65) Prior Publication Data

US 2005/0282629 A1 Dec. 22, 2005

Related U.S. Application Data

(60) Provisional application No. 60/581,739, filed on Jun. 21, 2004.

(51) Int. Cl.
*A63F 9/00* (2006.01)

(52) U.S. Cl. ..... 463/30

(58) Field of Classification Search ..... 463/30
See application file for complete search history.

(56) References Cited

U.S. PATENT DOCUMENTS

| | | | | |
|---|---|---|---|---|
| 6,217,448 | B1 * | 4/2001 | Olsen | 463/25 |
| 6,997,803 | B2 * | 2/2006 | LeMay et al. | 463/20 |
| 7,008,324 | B1 * | 3/2006 | Johnson et al. | 463/42 |
| 7,314,408 | B2 * | 1/2008 | Cannon | 463/16 |
| 7,431,297 | B2 * | 10/2008 | Kaji et al. | 273/237 |
| 7,662,040 | B2 * | 2/2010 | Englman et al. | 463/42 |
| 2002/0160826 | A1 * | 10/2002 | Gomez et al. | 463/16 |

* cited by examiner

*Primary Examiner* — Dmitry Suhol
*Assistant Examiner* — Malina K Rustemeyer
(74) *Attorney, Agent, or Firm* — Schwegman, Lundberg & Woessner, P.A.

(57) ABSTRACT

Systems and methods for controlling an overhead sign in a system of gaming machines and a sign controller are described. One aspect of the systems and methods includes allowing a gaming machine to send events comprising a script to a sign through a sign controller.

20 Claims, 5 Drawing Sheets

SYSTEM AND METHODS FOR CONTROLLING AN OVERHEAD SIGN FOR A GAMING SYSTEM

RELATED FILES

This application claims the benefit of U.S. Provisional Patent application Ser. No. 60/581,739, filed Jun. 21, 2004, entitled "SYSTEM AND METHODS FOR CONTROLLING AN OVERHEAD SIGN FOR A GAMING SYSTEM" which is hereby incorporated by reference.

FIELD

The present invention relates generally to gaming machine systems, and more particularly to controlling overhead signs in gaming machine systems.

COPYRIGHT NOTICE/PERMISSION

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever. The following notice applies to the software and data as described below and in the drawings hereto: Copyright © 2004, WMS Gaming, Inc. All Rights Reserved.

SUMMARY

The above-mentioned shortcomings, disadvantages and problems are addressed by the present invention, which will be understood by reading and studying the following specification.

Systems and methods for controlling an overhead sign in a system of gaming machines and a sign controller are described. One aspect of the systems and methods includes allowing a gaming machine to send events comprising a script to a sign through a sign controller. The sign events cause the sign to be updated with text and images defined using the sign events.

The present invention describes systems, methods, and computer-readable media of varying scope. In addition to the aspects and advantages of the present invention described in this summary, further aspects and advantages of the invention will become apparent by reference to the drawings and by reading the detailed description that follows.

DETAILED DESCRIPTION

Figure 1:
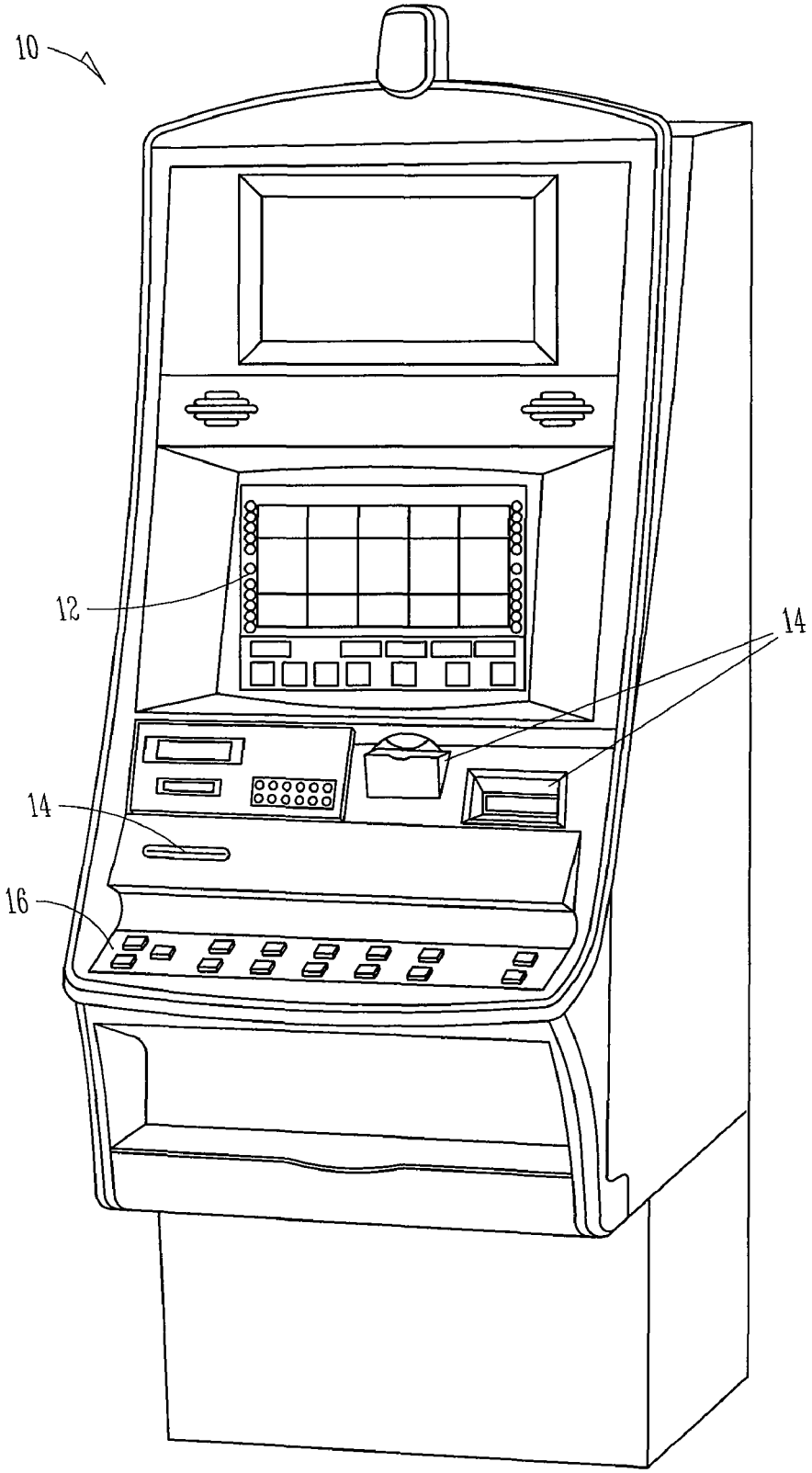
FIG. 1 is a perspective view of a gaming machine embodying the present invention.

In the following detailed description of exemplary embodiments of the invention, reference is made to the accompanying drawings which form a part hereof, and in which is shown by way of illustration specific exemplary embodiments in which the invention may be practiced. These embodiments are described in sufficient detail to enable those skilled in the art to practice the invention, and it is to be understood that other embodiments may be utilized and that logical, mechanical, electrical and other changes may be made without departing from the scope of the present invention.

Some portions of the detailed descriptions which follow are presented in terms of algorithms and symbolic representations of operations on data bits within a computer memory. These algorithmic descriptions and representations are the ways used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities. Unless specifically stated otherwise as apparent from the following discussions, terms such as "processing" or "computing" or "calculating" or "determining" or "displaying" or the like, refer to the action and processes of a computer system, or similar computing device, that manipulates and transforms data represented as physical (e.g., electronic) quantities within the computer system's registers and memories into other data similarly represented as physical quantities within the computer system memories or registers or other such information storage, transmission or display devices.

In the Figures, the same reference number is used throughout to refer to an identical component which appears in multiple Figures. Signals and connections may be referred to by the same reference number or label, and the actual meaning will be clear from its use in the context of the description.

The description of the various embodiments is to be construed as exemplary only and does not describe every possible instance of the invention. Numerous alternatives could be implemented, using combinations of current or future technologies, which would still fall within the scope of the claims. The following detailed description is, therefore, not to be taken in a limiting sense, and the scope of the present invention is defined only by the appended claims.

Operating Environment

FIG. 1 illustrates an exemplary gaming machine 10 in which embodiments of the invention may be implemented. In some embodiments, gaming machine 10 is operable to conduct a wagering game such as mechanical or video slots, poker, keno, bingo, or blackjack. If based in video, the gaming machine 10 includes a video display 12 such as a cathode ray tube (CRT), liquid crystal display (LCD), plasma, or other type of video display known in the art. A touch screen preferably overlies the display 12. In the illustrated embodiment, the gaming machine 10 is an "upright" version in which the display 12 is oriented vertically relative to a player. Alternatively, the gaming machine may be a "slant-top" version in which the display 12 is slanted at about a thirty-degree angle toward the player.

The gaming machine 10 includes a plurality of possible credit receiving mechanisms 14 for receiving credits to be used for placing wagers in the game. The credit receiving mechanisms 14 may, for example, include a coin acceptor, a bill acceptor, a ticket reader, and a card reader. The bill acceptor and the ticket reader may be combined into a single unit. The card reader may, for example, accept magnetic cards and smart (chip) cards coded with money or designating an account containing money.

In some embodiments, the gaming machine 10 includes a user interface comprising a plurality of push-buttons 16, the above-noted touch screen, and other possible devices. The plurality of push-buttons 16 may, for example, include one or more "bet" buttons for wagering, a "play" button for commencing play, a "collect" button for cashing out, a "help" button for viewing a help screen, a "pay table" button for viewing the pay table(s), and a "call attendant" button for calling an attendant. Additional game specific buttons may be provided to facilitate play of the specific game executed on the machine. The touch screen may define touch keys for implementing many of the same functions as the push-buttons. Other possible user interface devices include a keyboard and a pointing device such as a mouse or trackball.

A processor controls operation of the gaming machine 10. In response to receiving a wager and a command to initiate play, the processor randomly selects a game outcome from a plurality of possible outcomes and causes the display 12 to depict indicia representative of the selected game outcome. In the case of slots for example mechanical or simulated slot reels are rotated and stopped to place symbols on the reels in visual association with one or more pay lines. If the selected outcome is one of the winning outcomes defined by a pay table, the CPU awards the player with a number of credits associated with the winning outcome.

Figure 2:
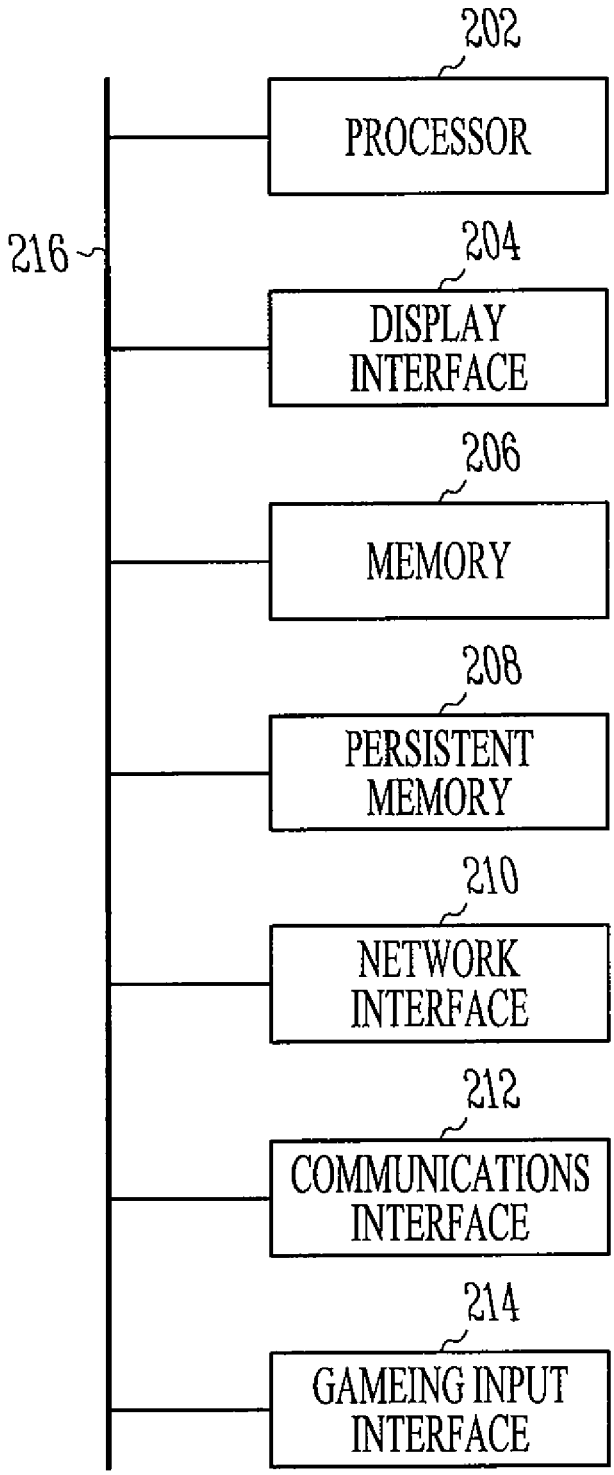
FIG. 2 is a block diagram of a gaming control system suitable for operating the gaming machine in FIG. 1.

FIG. 2 is a block diagram of a gaming control system 200 suitable for controlling the operation of the gaming machine 10 in FIG. 1. In some embodiments of the invention, gaming control system 200 includes one or more processors 202, one or more displays 204, memory 206, persistent memory 208, network interface 210, communications interface 212, gaming input interface 214 all communicably coupled via a bus 216 Processor 202 executes operating system and gaming software stored in memories 206 and 208. In some embodiments, processor 202 may be a processor from the Intel Pentium® family of processors, however the invention is not limited to any particular processor. Memory 206 may be a random-access memory capable of storing instructions and data used by an operating system and gaming application.

Persistent memory 208 is a memory that may be used to store operating system and gaming software for loading and execution by processor 202. Persistent memory 208 may be a ROM, a flash memory, a hard drive, a CD-ROM, DVD-ROM or other type of memory able to persistently store software and data.

Display interface 204 operates to control one or more displays such as display 12 of gaming machine 10.

Figure 3:
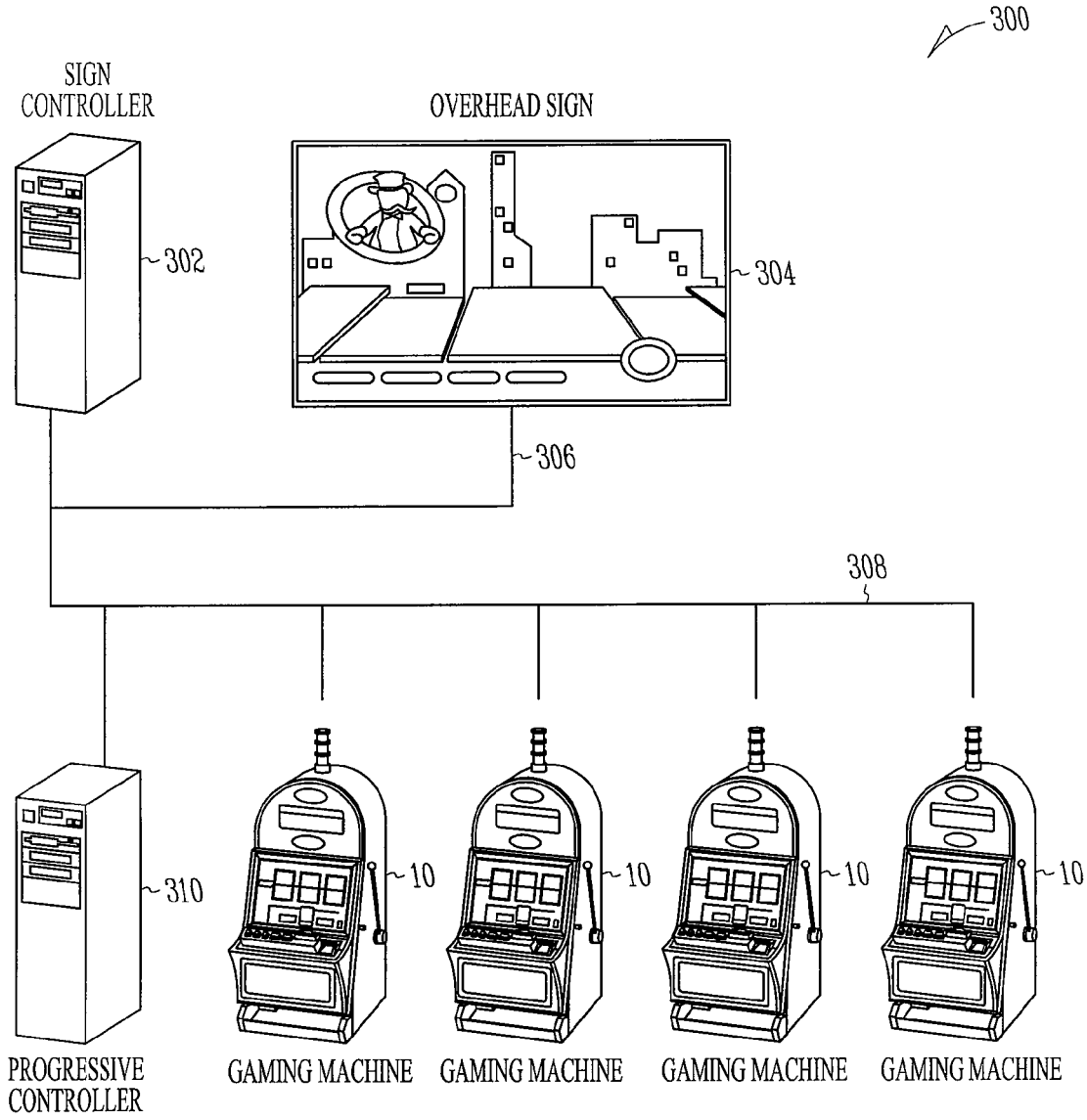
FIG. 3 is a block diagram of a software environment for a gaming system incorporating varying embodiments of the invention.

FIG. 3 is a block diagram of a software environment 300 for a gaming system incorporating varying embodiments of the invention. In some embodiments, software environment 300 includes sign controller 302, communicatively coupled to sign 304 by network 306, and gaming machines 10 communicatively coupled to sign controller 302 by network 308. Sign 304 is typically an overhead sign that is provided over a group of gaming machines 10. Sign controller 302 operates to control the output provided on sign 304. In some embodiments, networks 306 and 308 are RS-485 based networks. Networks 306 and 308 may be logical segments on the same physical network. However, in some embodiments, even if gaming machines 10 are on the same physical network, communication to sign 304 is restricted to sign controller 302. This may be enforced by a master-slave relationship between controller 302, gaming machines 10, and sign 304, with sign controller 302 acting as the master. In some embodiments, gaming machines and signs on networks 306 and 308 respond to polls from the sign controller 302. In some embodiments, these polls are RS-485 universal polls.

In general, the system operates as follows. When set to idle mode by sign controller 302, sign 304 operates as a progressive sign, displaying progressive meter values provided by progressive game controller 310. In addition, sign 304 may provide attraction output designed to attract game players to gaming machines 10.

At predetermined points in the execution of a wagering game, a gaming machine may be given control of sign 304. In some embodiments, a gaming machine does this by sending a message to sign controller 302 indicating that the gaming machine desires to take control of sign 304. In some embodiments, requests to take control of sign 304 are given a priority. In these embodiments, a gaming machine may take control of sign 304 if sign controller 302 determines that it is the highest priority entity desiring to take control of sign 304.

Sign 304 is placed in script mode if a gaming machine is successful in taking control of the sign. In this mode, sign events from the controlling gaming machine 10 are sent to sign 304. These sign events comprise a script that may cause a "celebration" output to be displayed on sign 304. For example, a celebration output may be displayed if a gaming machine 10 has a jackpot win. In addition, the sign events may cause sign 304 to mimic or reflect a bonus game currently being played on gaming machine 10. Typically the sign events show/hide images, animations or collections of images and/or animations. In some embodiments, the sign events comprise a script in an abbreviated XML format that comprises an identifier followed by one or more algebraic commands to be applied to the specified entity.

When a gaming machine 10 no longer desires control of sign 304, it may send a resume command or message to controller 302. Controller 302 causes sign 304 to resume idle mode, and sign 304 is then available for other gaming machines to take control. Additionally, ins some embodiments, if at any point during a gaming machines control of sign 304 another gaming machine issues a higher priority command to take control of sign 304, then sign controller 302 will allow the higher priority gaming machine to start controlling sign 304.

In addition, in some embodiments, sign 304 will resume idle mode under the following conditions:

If it loses communication with controller 302

If it is in Script mode and does not receive any Set Script commands over a period that exceeds ten minutes.

Additionally, when sign 304 returns to Idle mode it shall terminate all running scripts in some embodiments.

Further, it should be noted that in some embodiments, only one gaming machine 10 can be in control of sign 304 at any given time. In some embodiments, controller 302 is responsible for enforcing ownership of sign 304. Controller 302 keeps track of the state of sign 304 (i.e. Idle mode or Script mode) and the identity and priority of the owning gaming machine 10 while sign 304 is in Script mode.

Figure 4:
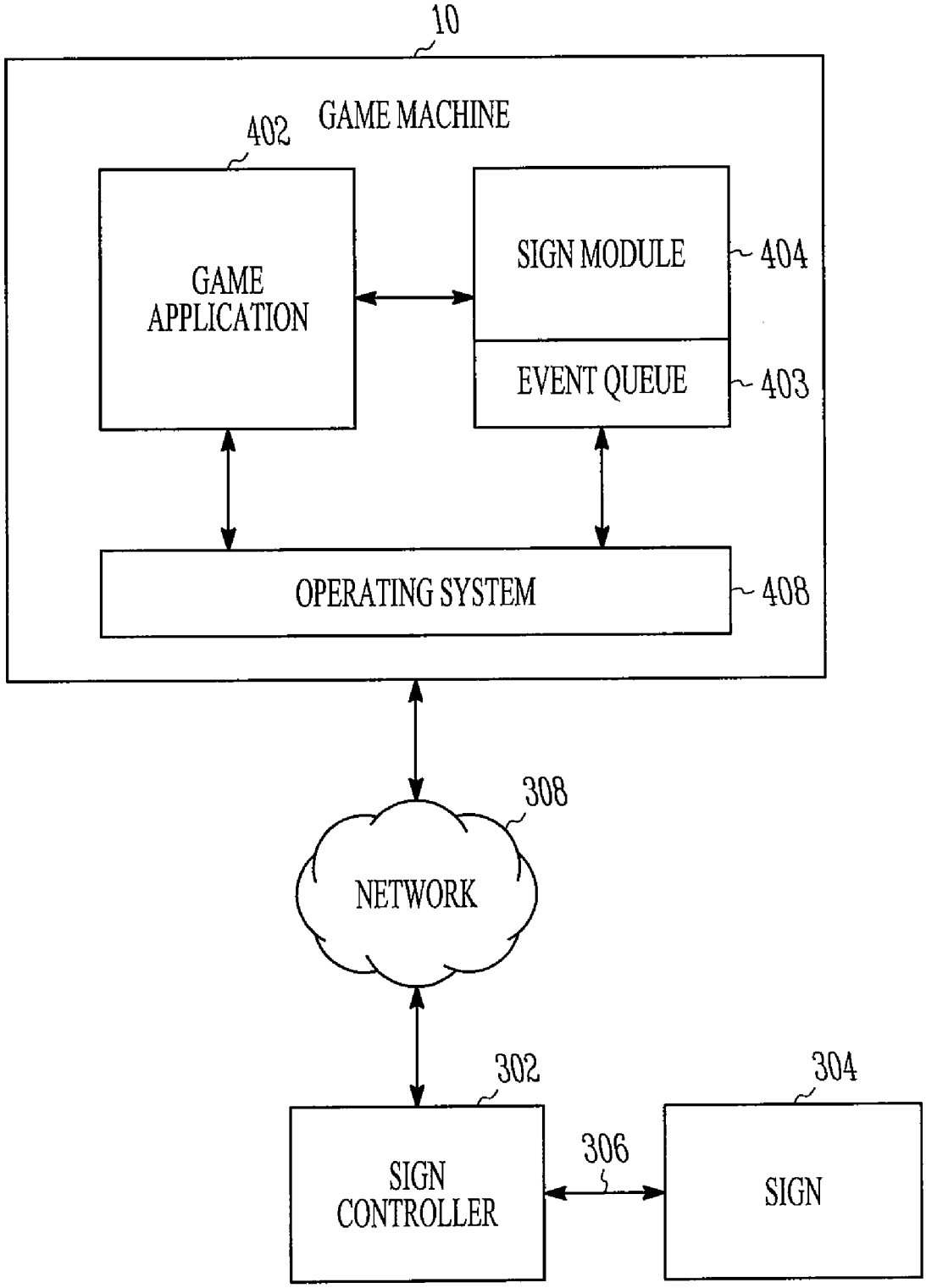
FIG. 4 is a block diagram providing further details on the major logical components of an exemplary gaming system incorporating varying embodiments of the invention.

FIG. 4 is a block diagram providing further details on the major logical components of an exemplary gaming system incorporating varying embodiments of the invention. In some embodiments, the processor and memory of gaming machine 10 execute an operating system 408 that controls the execution of game application 402 and sign module 404. Game application 404 may be any gaming application, including video poker, keno, slots, bingo, pachinko, or other game typical in the gaming industry. At predetermined points, gaming application 404 issues requests to sign module 404 to display output on sign 304. These requests may take the form of messages, function calls, remote procedure calls or other mechanisms known in the art.

Sign module 404 places sign events issued by the game application 402 in an event queue 406 for transmission to sign controller 302 over network 308. In some embodiments, gaming application 402 is generally unaware of whether it has control over sign 304 or not. Play on a gaming machine will continue regardless of whether or not it has control of sign 304.

Figure 5:
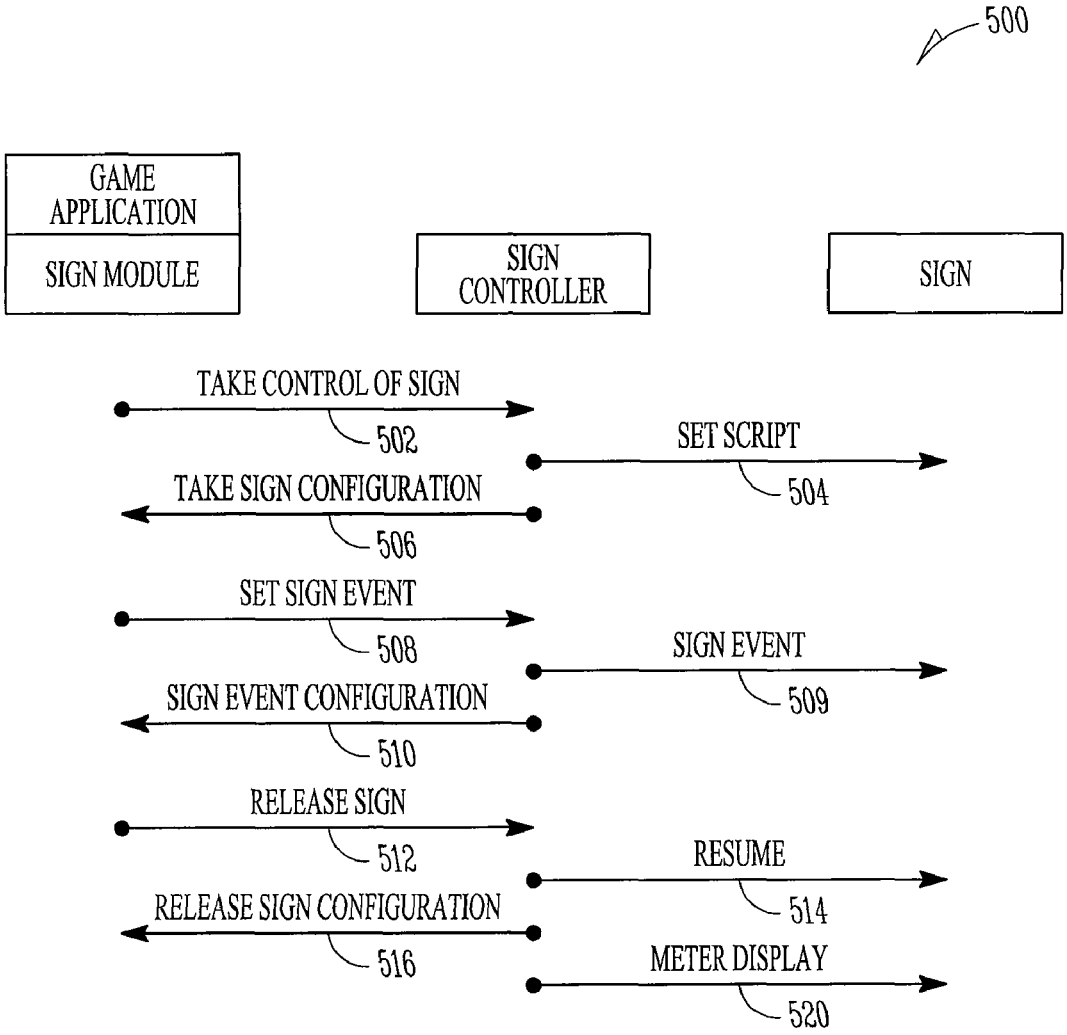
FIG. 5 is a flowchart illustrating a method for controlling an overhead sign according to various embodiments of the invention.

FIG. 5 is a flowchart illustrating a method for controlling an overhead sign according to various embodiments of the invention. The flowchart provides an exemplary illustration of a message flow from a game application 402 and sign module 404 to a controller 302 and from the controller 302 to sign 304. Those of skill in the art will appreciate that alternative message sequences are possible. In addition, those of skill in the art will appreciate that confirmation messages may be sent by controller 302 either before or after the confirmed output is sent to sign 304.

The method begins when a sign session is initiated by a game application 402 issuing a Take Control of Sign operation to the sign module 404. This causes the gaming machine to attempt to gain control of the sign by sending a Take Control of Sign message to the controller 302 (block 502). In some embodiments, this message may be sent in response to a Universal Poll.

Controller 302 will respond to the Take Control of Sign message by returning a Take Sign Confirmation that either grants or denies the request (block 506). If the sign 304 is Idle or if currently owned at a lower priority, then controller 302 will grant ownership of sign 304 to the requesting gaming machine. If another gaming machine at an equal or greater priority currently owns sign 304, then controller 302 will deny the request. If the requesting gaming machine already has control of sign 304 then controller 302 will grant ownership at the new priority.

In some embodiments, if the gaming machine 10 does not receive the Take Sign Confirmation prior to the next Universal Poll it will repeat the Take Control of Sign message. In particular embodiments, if the gaming machine repeats this message three times without receiving a Take Sign Confirmation from controller 302, then the gaming machine will relinquish control of the sign, as described below.

Next, if ownership is granted then sign module subsystem 404 shall queue Set Sign Event messages received from the game application 402 in chronological order for subsequent reporting to controller 302 (block 508). If ownership is denied, then the sign module subsystem 404 may discard subsequent Set Sign Event commands until another Take Control of Sign operation is issued by the game application 402. In particular embodiments, each Set Sign Event command may contain up to 50 events.

The sign module 404 for the gaming machine sends Set Sign Event messages to the Controller in response to a subsequent Universal Poll (block 508). Controller 302 acknowledges this message by returning a Set Event Confirmation message to the gaming machine (block 510). In some embodiments, the confirmation is sent prior to sending the next Universal Poll.

In addition, controller 302 forwards the sign event to sign 304 for display (block 509). When sign 304 receives a Set Sign Event command from controller 302 it will enter the Script mode and trigger the events specified in the command.

In some embodiments, if the gaming machine does not receive the Set Event Confirmation prior to the next Universal Poll it will repeat the same Set Sign Event message. In particular embodiments, if the gaming machine repeats this message three times without receiving a confirmation from controller 302, then the gaming machine will relinquish control of the sign, as described below.

In some embodiments, controller 302 is responsible for filtering Set Sign Event messages. Messages received from the current owner gaming machine are forwarded to sign 304 and acknowledged by returning a Set Event Confirmation message to the gaming machine (block 510). Set Sign Event messages received from any other gaming machine are acknowledged and then discarded by controller 302. In some embodiments, sign 304 only receives Set Sign Event messages that were issued by the owning gaming machine.

When the game application no longer desires to place output on sign 304 (e.g. it has finished the bonus round or celebration) it will issue a Release Sign operation to the sign module subsystem. This operation is queued and sent to controller 302 after pending sign events have been sent from the queue (block 512).

The gaming machine sends a Release Sign message to the Controller in response to a Universal Poll. When controller 302 receives a Release Sign message from the current owner it may release ownership of sign 304 by sending a Resume command to the Sign. The controller 302 acknowledges the message by returning a Release Sign Confirmation message to the gaming machine. The confirmation may be sent prior to sending the next Universal Poll. If controller 302 receives a Release Sign message from a gaming machine that is not the current owner then the Controller may acknowledge and discard the message.

In some embodiments, if the gaming machine does not receive the Release Sign Confirmation prior to the next Universal Poll it will repeat the same Release Sign message. In particular embodiments, if the gaming machine repeats this message three times without receiving a confirmation from controller 302 then the gaming machine may discard the Release Sign message and return to normal operation.

Upon receipt of the Resume command sign 304 will return to idle mode. In some embodiments, when sign 304 returns to idle mode it terminates previously initiated scripts.

It should be noted that the gaming machine may relinquish control of the sign if it fails to receive an appropriate confirmation message from controller 302, as discussed above.

When the gaming machine relinquishes control of the sign it may perform some or all of the following steps.

Discards the Take Control of Sign operation if one is queued.

Discards any Set Sign Event operations that may be queued.

Reports a Release Sign operation to controller 302 as described above.

If ownership of the sign is relinquished, then the gaming machine may discard subsequent sign operations received from the Game until another Take Control of Sign operation is issued by the Game.

Note that in some embodiments, controller 302 may also release ownership of sign 304 under the following abnormal conditions:

If it looses communication with the current owner

If it does not receive any Set Sign Event commands from the current owner for a period that exceeds ten minutes.

The Controller typically does not inform the owning GM when ownership has been released under these circumstances.

In addition, in some embodiments, controller 302 periodically sends Meter Display messages to the Sign to update the progressive values. In some embodiments, controller 302 will continue to send Meter Display messages even when the Sign is in Script mode. In these embodiments, sign 304 shall store the most recent progressive values regardless of mode. Sign 304 resumes display of progressive meters with the most recent values when it returns to Idle mode.

CONCLUSION

Systems and methods for controlling an overhead sign in a system of gaming machines and a sign controller have been disclosed. The systems and methods described provide advantages over previous systems. Although specific embodiments have been illustrated and described herein, it will be appreciated by those of ordinary skill in the art that any arrangement which is calculated to achieve the same purpose may be substituted for the specific embodiments shown. This application is intended to cover any adaptations or variations of the present invention.

The terminology used in this application is meant to include all of these environments. It is to be understood that the above description is intended to be illustrative, and not restrictive. Many other embodiments will be apparent to those of skill in the art upon reviewing the above description.

What is claimed is:

1. A method for controlling a sign in a gaming system, the method comprising:

operating a sign display in an idle mode, the sign communicatively coupled to a first gaming machine and a second gaming machine;

initiating by the first gaming machine a first sign control session, the session having a first priority;

receiving sign commands from the first gaming machine;

updating the sign display in response to the sign commands;

initiating by the second gaming machine a second sign control session for the sign display, the session having a second priority, wherein the first gaming machine and the second gaming machine compete for control of the sign based on the first priority and the second priority;

maintaining control of the sign display with the first sign control session in response to determining the first priority is higher than the second priority or switching control to the second sign control session in response to determining the second priority is higher than the first priority;

receiving one or more updated progressive meter values from a progressive game controller while the sign display is controlled by at least one of the first gaming machine or the second gaming machine;

storing one or more updated progressive meter values;

displaying a most recent value of the one or more updated progressive meter values upon returning the sign display to the idle model; and returning the sign display to the idle mode.

2. The method of claim 1, further comprising sending a sign control response indicating that the second gaming machine may control the sign.

3. The method of claim 1, wherein returning the sign display to the idle mode includes determining the sign controller has lost communication with the first gaming machine and the second gaming machine.

4. The method of claim 1, wherein returning the sign display to the idle mode includes determining a sign command has not been received for an idle period.

5. The method of claim 1, wherein receiving sign commands includes receiving a script including the sign commands.

6. The method of claim 1, wherein the sign commands comprise a bonus round display.

7. The method of claim 1, wherein the sign commands comprise a celebration display.

8. A gaming system comprising:

a sign having a display;

a sign controller communicably coupled to the sign and operable to operate the sign in at least an idle mode and a control mode;

a plurality of gaming machines communicably coupled to the sign controller, the plurality of gaming machines each having a sign control session having a priority, the plurality of gaming machines competing for control of the sign based on the priority;

a progressive controller communicably coupled to the sign controller and operable to send progressive sign updates to the sign controller and store one or more updated progressive meter values while the sign display is controlled by at least one of the plurality of gaming machines; and wherein during the control mode the sign controller receives sign events from at least two of the sign control sessions and updates the display in response to the sign events received from the sign control session having the highest priority and wherein during the idle mode the sign controller displays a most recent value of the one or more updated progressive meter values received from the progressive controller.

9. The gaming system of claim 8, wherein the sign display comprises an attract mode display when the sign is operated in the idle mode.

10. The gaming system of claim 8, wherein the sign controller and the plurality of gaming machines are communicably coupled through an RS-485 network.

11. A computer-readable medium having stored thereon computer executable instructions for causing one or more processors to perform a method for controlling a sign in a gaming system, the method comprising:

operating a sign display in an idle mode, the sign communicatively coupled to a first gaming machine and a second gaming machine;

initiating by the first gaming machine a first sign control session, the session having a first priority;

receiving sign commands from the first gaming machine;

updating the sign display in response to the sign commands;

initiating by the second gaming machine a second sign control session for the sign display, the session having a second priority, wherein the first gaming machine and the second gaming machine compete for control of the sign based on the first priority and the second priority;

maintaining control of the sign display with the first sign control session in response to determining the first priority is higher than the second priority or switching control to the second sign control session in response to determining the second priority is higher than the first priority;

receiving one or more updated progressive meter values from a progressive game controller while the sign display is controlled by at least one of the first gaming machine or the second gaming machine;

storing the one or more updated progressive meter values;

displaying a most recent value of the one or more updated progressive meter values upon returning the sign display to the idle mode; and returning the sign display to the idle mode.

12. The computer-readable medium of claim 11, further comprising sending a sign control response indicating that the first gaming machine may control the sign.

13. The computer-readable medium of claim 11, wherein returning the sign display to the idle mode includes determining the sign controller has lost communication with the first gaming machine and the second gaming machine.

14. The computer-readable medium of claim 11, wherein returning the sign display to the idle mode includes determining a sign command has not been received for an idle period.

15. The computer-readable medium of claim 11, wherein receiving sign commands includes receiving a script including the sign commands.

16. The computer-readable medium of claim 11, wherein the sign commands comprise a bonus round display.

17. The computer-readable medium of claim 11, wherein the sign update commands comprise a celebration display.

18. A method for operating a sign display, the method comprising:

issuing a universal poll to a plurality of gaming machines on a network, wherein the plurality of gaming machines compete for control of the sign during the operation of the sign based on priority;

in response to the universal poll, receiving a take control of sign request message from a first gaming machine of the plurality of gaming machines, the message indicating a first priority;

upon determining that the sign display is idle or being controlled by a second gaming machine of the plurality of gaming machines at a lower priority than the first priority, then granting ownership of the sign to the first gaming machine at the first priority, otherwise denying ownership to the first gaming machine;

sending a confirmation message to the first gaming machine indicating the status of the take control of sign request;

receiving one or more updated progressive meter values from a progressive game controller while a gaming machine of the plurality of gaming machines controls the sign display;

storing a most recent value of the one or more updated progressive meter values; and displaying the most recent one or more updated progressive meter values upon returning the sign display to an idle mode.

19. The method of claim 18, and further comprising:

determining by the first gaming machine that the confirmation message has not been received prior to a subsequent universal poll; and reissuing the take control of sign request.

20. The method of claim 18, and further comprising:

receiving the confirmation message;

upon a subsequent universal poll sending a set sign event command, the set sign event command including one or more events; and receiving a sign event confirmation message.

* * * * *